United States Patent [19]

Bivens et al.

[11] 4,191,331

[45] Mar. 4, 1980

[54] STREAM REVERSING DIRECTOR

[75] Inventors: Jon A. Bivens, Upland; Wilson V. Cochran, Riverside, both of Calif.

[73] Assignee: The Toro Company, Riverside, Calif.

[21] Appl. No.: 889,257

[22] Filed: Mar. 23, 1978

[51] Int. Cl.[2] ..... B05B 3/08

[52] U.S. Cl. ..... 239/231; 239/498; 239/522; 239/DIG. 1

[58] Field of Search ..... 239/DIG. 1, 231, 232, 239/222.13, 498, 522

[56] References Cited

U.S. PATENT DOCUMENTS

| | | | |
|---|---|---|---|
| 561,286 | 6/1896 | Schild | 239/522 |
| 691,758 | 1/1902 | Gay | 239/498 |
| 1,763,119 | 6/1930 | Archer | 239/522 |
| 1,764,570 | 6/1930 | Lohman | 239/523 |
| 2,505,582 | 4/1950 | Unger | 239/222.19 |
| 2,639,191 | 5/1953 | Hruby, Jr. | 239/231 |
| 2,709,623 | 5/1955 | Glynn | 239/488 |
| 2,955,764 | 10/1960 | Hruby, Jr. | 239/231 |
| 3,009,648 | 11/1961 | Hait | 239/522 |
| 3,009,651 | 11/1961 | Wolf | 239/222.13 |
| 3,009,652 | 11/1961 | McKay | 239/231 |

*Primary Examiner*—John J. Love
*Assistant Examiner*—Michael J. Forman
*Attorney, Agent, or Firm*—Poms, Smith, Lande & Rose

[57] ABSTRACT

A stream director is disclosed adapted for mounting on a rotary sprinkler head to redirect the water stream during a segment of the rotation of the sprinkler from its intended portion of the irrigation area to another portion. A plurality of closed adjacent smoothly curved channels are employed to confine and redirect the stream emanating from the nozzle prior to its break-up whereby the spray pattern from the sprinkler is substantially as if the sprinkler were rotating through only a portion of a circular area.

5 Claims, 8 Drawing Figures

STREAM REVERSING DIRECTOR

BACKGROUND OF THE INVENTION

The present invention relates to irrigation sprinklers and more particularly to sprinklers rotating about a vertical axis of rotation adapted to irrigate only a portion of a circle surrounding the sprinkler.

Referring first to FIG. 3, a sprinkler of one design wherein the present invention is particularly useful is shown in partially cut-away elevation. The sprinkler, generally indicated as 10, has a hollow cylindrical body 12 having a cylindrical shoulder area 14 at the top thereof. A turbine motor 16 is disposed longitudinally within the cylindrical body 12. Turbine motor 16 has an output shaft 20 connected to a rotating head 22 disposed within shoulder area 14 and having a nozzle opening 24 contained therein. The bottom of body 12 is adapted for connection to a source of water 18 under pressure and contains a turbine blade (not shown) operably connected to the turbine motor 16. When water 18 enters body 12, it passes through the turbine blade causing turbine motor 16 to rotate output shaft 20 and rotate head 22 in combination therewith. Water 18 continues past the turbine motor 16 into the rotating head 22 where it exits through nozzle opening 24 as water stream 26. With nothing more, such a sprinkler 10 would water a circular area as indicated by the total cross-hatched area in FIG. 1.

Often, however, it is desirable to be able to water only a portion of a circular area such as indicated by the semi-circle double cross-hatched in FIG. 1. According to the prior art, in rotating sprinklers such as that indicated as 10 in FIG. 3 and other rotating sprinklers such as the "impulse" type indicated generally as 28 of FIG. 8, complicated mechanisms have been employed to reverse the direction of rotation of the rotating head 22, or the like, in order to sprinkle partial circular patterns.

In large portable agricultural irrigation systems, the sprinklers are moved to various locations throughout the area. Sometimes, it is desired that they sprinkle a circular area being disposed within the interior of the plot being irrigated. At other times, a particular sprinkler is alongside a roadway wherein partial circular watering is desirable to prevent unnecessary and irritating watering of the adjacent roadway. Particularly in such agricultural applications, the necessity for specifically selecting sprinklers or readjusting the pattern is an irrigation, not to mention the higher cost and increased complexity attendant such mechanically reversing sprinklers.

Wherefore, it is the object of the present invention to provide a low cost, simple apparatus for modifying a non-reversing rotating sprinkler to irrigate a selected area in the same manner as if the sprinkler head were reversing.

DESCRIPTION OF THE PREFERRED EMBODIMENT

Figure 1:
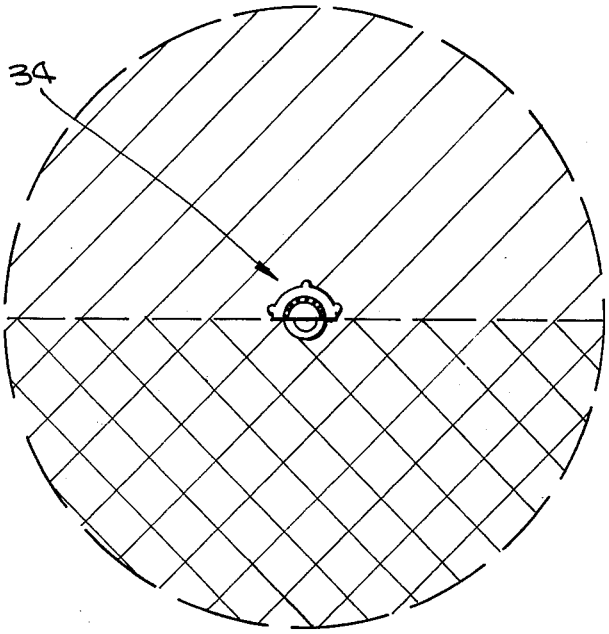
FIG. 1 is a plan view of a sprinkler head and the irrigation area irrigated thereby indicating the normal circular pattern for a non-reversing rotary sprinkler and the semi-circular pattern sprinkled by incorporating one embodiment of the present invention.
Figure 5:
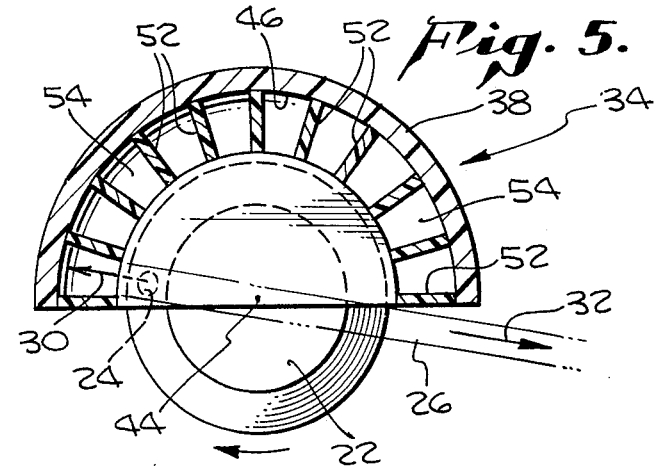
FIG. 5 is a cut-away plan view of the sprinkler of FIG. 2 showing the stream being deflected at the start of its deflection cycle.
Figure 6:
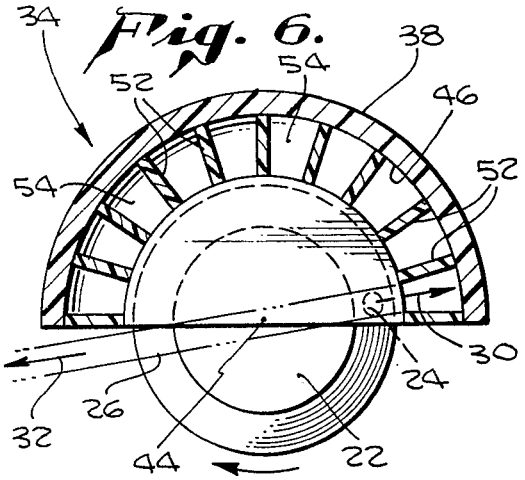
FIG. 6 is a cut-away plan view through the apparatus of FIG. 2 showing the reversing operation in its last segment of reversal watering.
Figure 7:
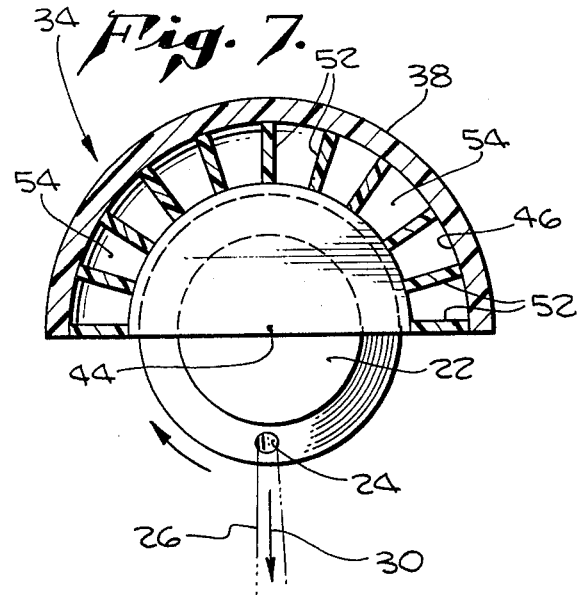
FIG. 7 is a cut-away plan view of the apparatus of FIG. 2 showing the nozzle watering the semi-circle of the irrigation area in a non-reversing mode.

The embodiment of the present invention described hereinafter is adapted for operation as shown in FIG. 1 wherein a sprinkler rotating throughout 360 degrees of rotation, which would normally sprinkle a full circle pattern, is adapted to sprinkle only a semi-circular pattern. That is, referring to FIGS. 2, 5, 6, and 7, the rotating head 22 rotates to cause the nozzle opening 24 to rotate through a 360-degree arc of rotation (i.e. a full circle). In normal operation, the nozzle opening 24 is adapted to shoot a confined stream of water 26 radially outward from head 22 in the direction nozzle opening 24 is facing. Water stream 26 exists nozzle opening 24 as a closely confined stream of water which breaks up as it passes through the resistance of the air in its travel, creating a dispersion thereof over a limited sector of the area being sprayed. According to the method of operation of the present invention, as the nozzle opening 24 traverses the semi-circular arc which causes the semi-circular area of desired watering to be watered, the normal operation is unhampered as shown in FIG. 7. Upon reaching the position shown in FIG. 5, however, the present invention causes the water stream 26 to be reversed from its intended direction, shown by the arrow 30, to exactly the opposite direction, as indicated by the arrow 32, which causes the desired irrigation area to be watered once again as if the nozzle opening were disposed 180 degrees from its actual location on the rotating head 22. This reversing action continues until the nozzle opening 24 has arrived at the position shown in FIG. 6 wherein the semi-circle of desired watering has been watered once again. Further rotation of the rotating head 22 causes the nozzle opening 24 to move into normal operation as shown in FIG. 7.

The stream reversing director of the present invention is generally indicated as 34. Director 34 comprises a mounting portion 36 and a redirecting portion 38. The embodiment being described herein was particularly adapted for use in conjunction with plastic bodied sprinklers generally configured as 10 manufactured by the assignee of the present invention. The body of the sprinkler 12 as well as the director 34 of the present invention are formed of high impact plastics. Inasmuch as the diameter of the cylindrical shoulder area 14 of sprinkler 10 in a tested embodiment is 1.5 inches, the stream reversing directors 34 are such that six or eight can easily be fit in a jacket pocket for instant application or removal as necessary. As can best be seen in FIG. 3, the mounting portion 36 has a cylindrical lower portion 40 adapted to releasably mate with the cylindrical shoulder area 14 of the sprinkler 10. A shoulder 42 is provided internally of mounting portion 36 to prevent sliding mounting portion 36 over cylindrically shoulder area 14 too far and to cause proper alignment between the nozzle opening 24 and the redirecting portion 38.

The redirecting portion 38 is disposed concentrically with the cylindrical lower portion 40 whereby the redirecting portion 38 is disposed concentrically with the axis of rotation 44 of the rotating head 22. The redirecting portion 38 is configured into a smooth groove 46 disposed to lie in a plane normal to the axis of rotation 44. The bottom or entry 48 of the groove 46 is disposed to be closed adjacent the nozzle opening 24 along its entire path of motion in the area wherein the water stream 26 is to be redirected. The closer that the entry 48 of groove 46 can be placed to the nozzle opening 24, the better the operation of the stream reversing director 34 of the present invention. As can be seen, groove 46 is configured to curve smoothly from its direction at entry 48 to substantially the opposite direction at the exit 50 thereof. To prevent the breaking up of the stream 26 prior to its redirection, a plurality of partitions 52 are disposed within the groove 46 to lie in a family of planes equally radially spaced and passing through the axis of rotation 44. The partitions 52 in combination with the groove 46 describe a plurality of closed adjacent channels 54 for confining and redirecting the water stream 26. The partitions 52 are made quite thin in relationship to the diameter of the water stream 26 whereby they act as a "knife" to cut or split the water stream 26 as it passes from one channel 54 to the next adjacent channel 54 in the rotation of rotating head 22 whereby break-up of the water stream 26 is not affected by the stream-facing edges of the partitions 52.

Figure 2:
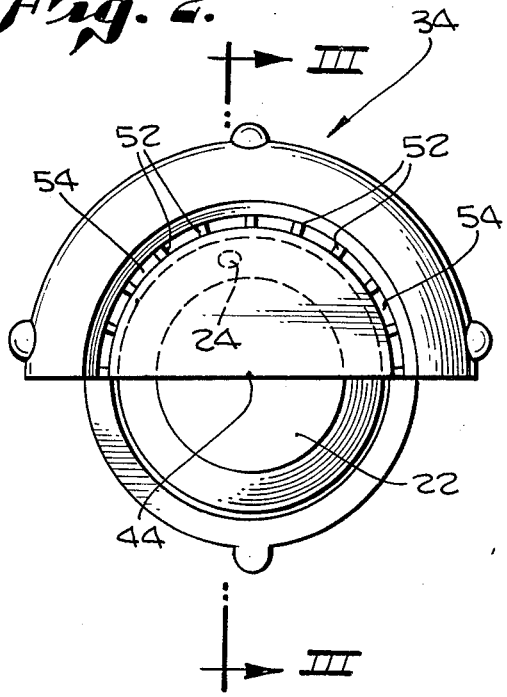
FIG. 2 is a detailed plan view of the sprinkler of FIG. 1 having the stream reversing director apparatus of the present invention for sprinkling a semi-circular area attached thereto.
Figure 3:
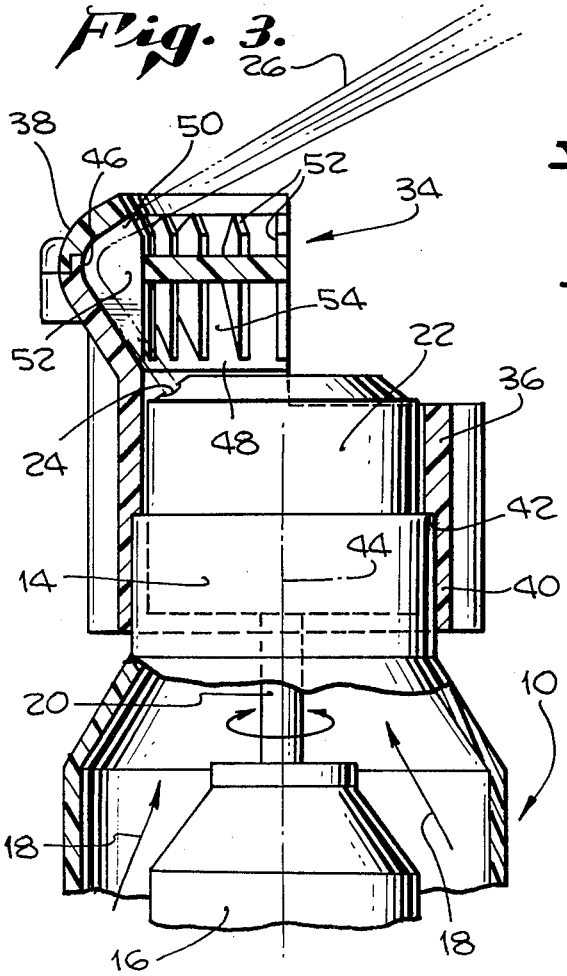
FIG. 3 is a partially cut-away elevation of the sprinkler of FIGS. 1 and 2 shown in the plane III—III.
Figure 4:
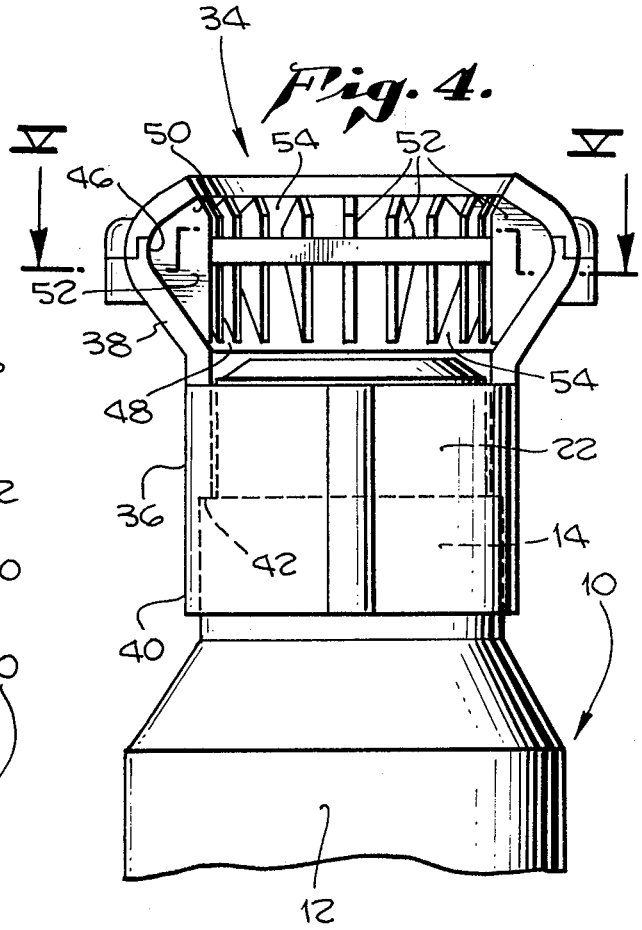
FIG. 4 is an elevation of the upper portion of the sprinkler of FIG. 2 showing the method of mounting the deflector of the present invention thereon.

The operation of the stream reversing director of the present invention can now be fully understood in light of the foregoing description with reference to FIGS. 2 and 3. Upon exit from nozzle opening 24, water stream 26 enters a channel 54 at the entry 48 of groove 46 between two adjacent partitions 52. Stream 26 is confined between the two partitions 52 as it traverses the smooth groove 46 between the entry 48 and exit 50 thereof. In the transition between the entry 48 and exit 50, the stream 26 in its confined state between the partitions 52 is reversed in direction so as to leave exit 50 in a substantially intact or confined state but in a reversed direction. With this in mind, reference to FIGS. 5 and 6 will show that as the rotating head 22 rotates causing the nozzle opening 24 to pass from adjacent one channel 54 to the next adjacent channel 54, the water stream 26 is caused to be reversed in direction whereby the segments of the semi-circular area to be watered are sequentially watered in substantially the same manner as when the nozzle opening 24 is traversing the area in its normal manner as shown in FIG. 7.

Figure 8:
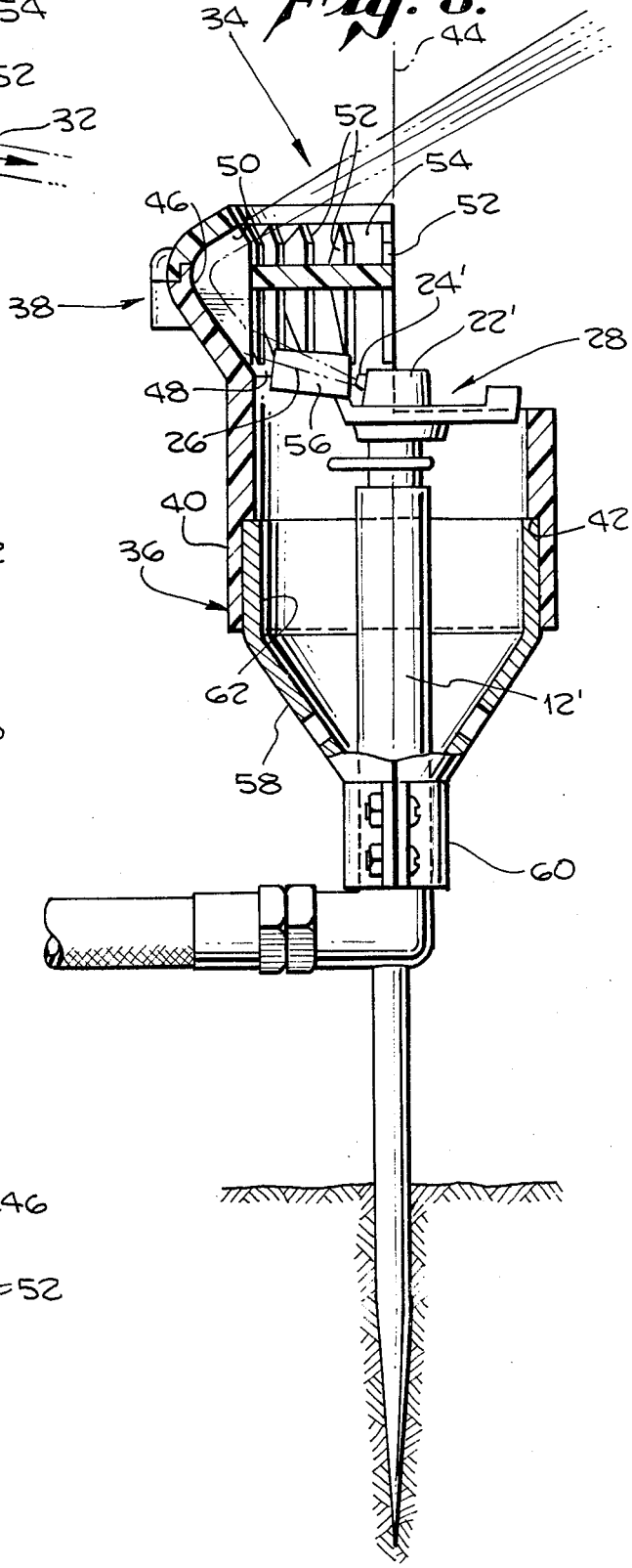
FIG. 8 is a partially cut-away elevation of the apparatus of the present invention in an alternate embodiment as used in conjunction with an impulse type sprinkler.

While the foregoing description has been in reference to a tested embodiment of the present invention particularly adapted for a small lawn sprinkler, the present invention is equally adaptable to larger sizes and other types of rotating sprinklers as indicated by the adaption thereof for use with an impulse type sprinkler as shown in FIG. 8. The impulse sprinkler 28 still comprises a rotating head 22 rotated about an axis of rotation 44 in relation to a hollow body 12. The rotary motion thereof is provided by an impulse blade 56 driven by the emerging water stream 26 rather than by an internal mechanism. In the adaption of our stream reversing director, generally indicated as 34', as applied to the impulse type sprinkler 28, the mounting portion 36 includes an additional mounting member 58 adapted for concentric mounting with the body 12' as by means of the screwed clamp 60. The mounting member 58 is provided with a cylindrical section 62 adapted to releasably mate with the cylindrical lower portion 40 previously described. In this manner, the director 34' can be removed from the sprinkler 28 or positionally adjusted as necessary. The embodiment as shown is configured to redirect only a quarter of a circle such as might be used with a sprinkler disposed at the corner of a house wherein three-quarters of the circle are desired to be watered and the quarter of the circle comprising the house adjacent the sprinkler is not desired to be watered.

Having thus described our invention, it can be seen that the objectives of the present invention have been provided in apparatus which sequentially confines and redirects a stream of water emanating from a rotating head of a sprinkler during the portion of the rotation thereof which would normally water a portion of an area by redirecting the water to another section of the area.

Wherefore, having thus described our invention, we claim:

1. In an irrigation sprinkler having a body with a rotating portion including a nozzle having an opening emitting a stream of irrigation water of cross-sectional diameter d and adapted for irrigating an area by rotating the rotating portion about an axis of rotation, the improvement for redirecting the stream of water intended for a part of the area to another of the area comprising:

a redirector adapted for mounting to the sprinkler body and having a partial-cylindrical portion disposed concentric to the axis of rotation adjacent the rotating portion of the sprinkler for a portion of the path of rotation of the nozzle opening and including in said partial-cylindrical portion a plurality of close adjacent guide channels each substantially of width d and having an inlet end and an outlet end, said channels lying in respective ones of a family of planes passing through the axis of rotation of the rotating portion, said inlet ends being positioned closed adjacent the path of travel of the nozzle opening to sequentially receive the stream of water from the nozzle as the rotating portion rotates, said guide channels being shaped from said inlet ends to said outlet ends to confine and smoothly redirect the stream of water from the nozzle intended for a portion of the part of the area not to be watered toward a portion of the part of the area where said redirected water is desired while maintaining the redirected water stream substantially identical in size and break-up characteristics to the unredirected water stream.

2. The sprinkler stream redirector of claim 1 wherein:

said plurality of channels is formed by a plurality of planar separators disposed to lie in respective ones of a family of equally radially spaced planes passing through the axis of rotation of the rotating portion and within a groove formed in said redirector in a plane normal to said axis of rotation.

3. The sprinkler stream redirector of claim 2 wherein:

said planar separators are of a thickness facing and adjacent to the emerging water stream in relation to the width of the water stream from the nozzle such that the water stream is split by the stream-facing edge of the separators as the rotating portion rotates the water stream from each of said channels to the next adjacent of said channels whereby break-up of the water stream by said stream facing edge of of said separators is minimized.

4. The sprinkler stream redirector of claim 1 wherein: said redirector includes a cylindrical mounting portion adapted to be releasably mated with a cylindrical portion of the sprinkler body to hold the inlets of said channels disposed close adjacent the path of the nozzle as it rotates.

5. In sprinkling apparatus employing a rotating sprinkler head having a nozzle opening emanating a stream of water therefrom, apparatus of watering only a portion of the area which would otherwise by watered by the sprinkler head comprising:

(a) means for sequentially receiving, confining, and redirecting the stream of water to another portion of the area to be watered as the nozzle opening traverses consecutive arcs of travel facing the portion of the area not to be watered, said receiving, confining, and redirecting means forming a plurality of adjacent guide channels each adapted to receive the stream of water from the nozzle intended for a portion of the part of the area not to be watered at an inlet end thereof and to confine and smoothly redirect the stream of water from an outlet end thereof toward a portion of the part of the area to be watered, each of said guide channels being of a width substantially equal to the width of the water stream, said plurality of channels being formed by a plurality of planar separators disposed to lie in respective ones of a family of equally radial spaced planes passing through the axis of rotation of the sprinkler head and within a groove disposed in said receiving, confining, and redirecting means in a plane normal to said axis of rotation, said separators having a stream-facing edge thin in relation to the width of the water stream whereby the stream is split by said stream-facing edge of said separators and not deflected thereby and the redirected stream is substantially identical in size and break-up characteristics to the unredirected water stream; and, (b) means for positioning said receiving, confining, and redirecting means concentric with the axis of rotation of the sprinkler head adjacent the path of travel of the nozzle.

* * * * *